United States Patent [19]

Cogswell et al.

[11] 4,130,207

[45] Dec. 19, 1978

[54] APPARATUS FOR STACKING BOOKLETS FROM THE TOP

[75] Inventors: John A. Cogswell, Medfield, Mass.; Fred E. Klaszky, Glen Ellyn; Anthony S. Jacobs, Glencoe, both of Ill.

[73] Assignee: The Wessel Company, Inc., Chicago, Ill.

[21] Appl. No.: 664,281

[22] Filed: Mar. 5, 1976

[51] Int. Cl.[2] ..... B65G 57/14

[52] U.S. Cl. ..... 214/6 D; 93/93 DP; 214/6 TS; 271/3.1; 271/35; 198/422

[58] Field of Search ..... 214/6 D, 6 TS, 6 S; 271/3.1, 35, 211, 213, 235; 93/93 DP, 93 L; 198/422

[56] References Cited

U.S. PATENT DOCUMENTS

| | | | |
|---|---|---|---|
| 2,919,789 | 1/1960 | Coakley | 198/422 |
| 3,194,126 | 7/1965 | Larsson | 214/6 D X |
| 3,374,902 | 3/1968 | Mills | 214/6 H |
| 3,382,966 | 5/1968 | Califano et al. | 214/6 D X |
| 3,491,902 | 1/1970 | Waldura | 271/211 X |
| 3,595,568 | 7/1971 | Roskam et al. | 214/6 H X |
| 3,683,758 | 8/1972 | Feldkamper | 93/93 DP |
| 3,708,368 | 1/1973 | Watson | 271/3.1 X |
| 3,905,490 | 9/1975 | Johnson | 271/3.1 X |
| 3,915,316 | 10/1975 | Pomara | 214/6 D |
| 3,942,786 | 3/1976 | Lauren | 271/80 X |
| 4,043,458 | 8/1977 | Schott | 93/93 DP X |

*Primary Examiner*—L. J. Paperner

*Attorney, Agent, or Firm*—Merriam, Marshall & Bicknell

[57] ABSTRACT

An apparatus piles a continuous stream of booklets in a stack, with a succeeding booklet in the stream being piled atop a preceding booklet. When the stack attains a predetermined size, the stack is ejected from the apparatus without stopping delivery to the apparatus of the continuous stream of booklets which are accumulated in a temporary holding stack, during ejection of the other stack. The temporary holding stack is depleted at a rate faster than it formed, following the ejection of the other stack.

6 Claims, 9 Drawing Figures

FIG. 4
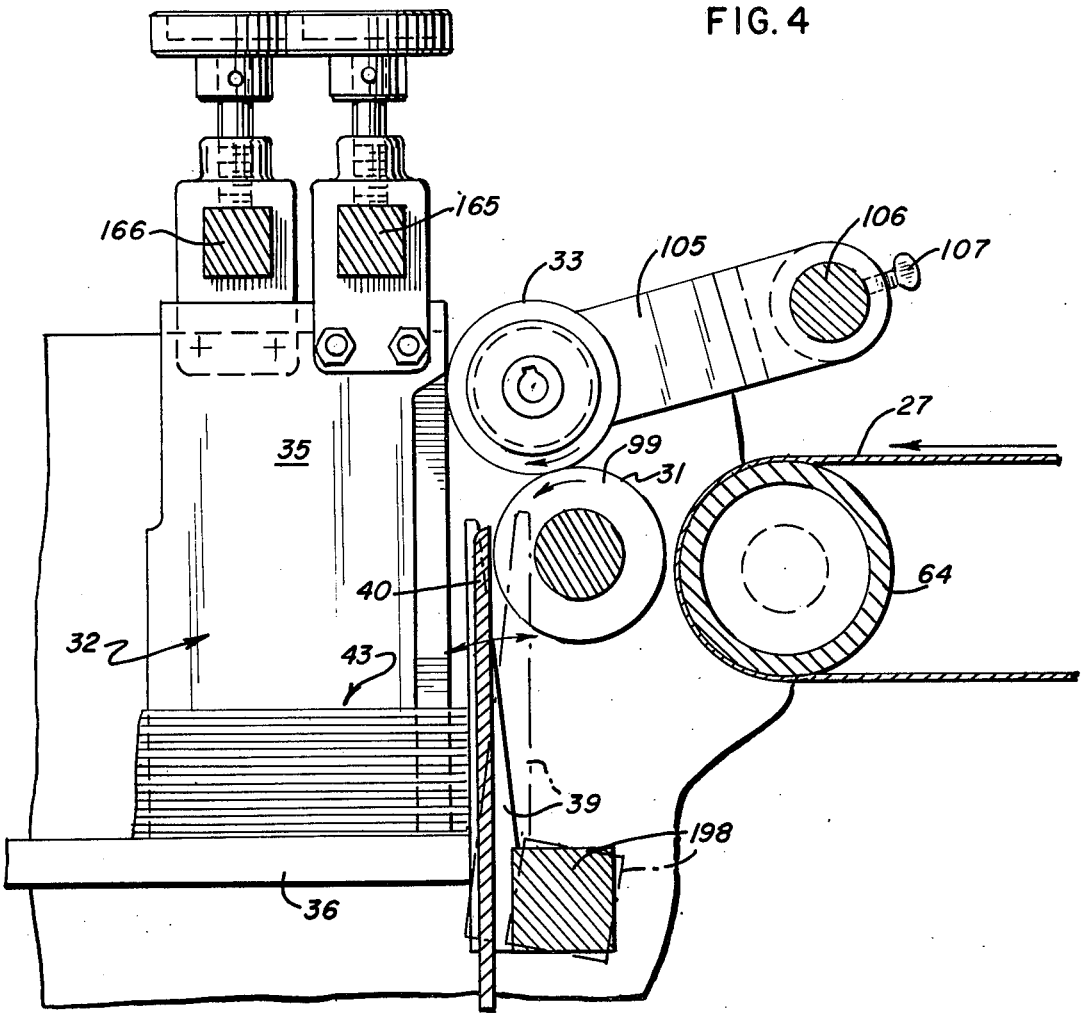
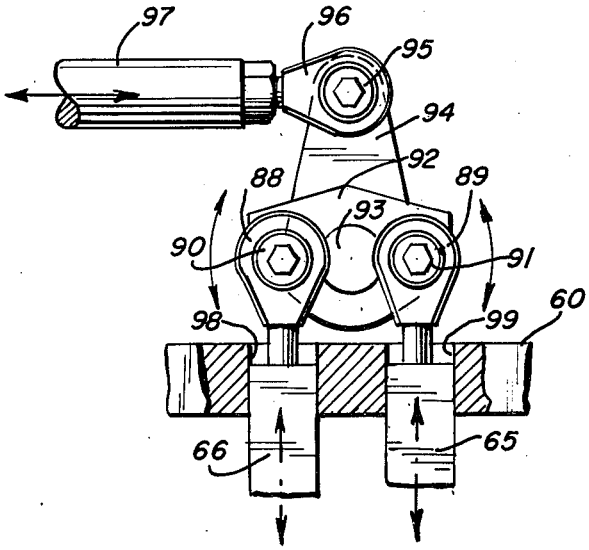
FIG. 6

APPARATUS FOR STACKING BOOKLETS FROM THE TOP

BACKGROUND OF THE INVENTION

The present invention relates generally to apparatus for stacking booklets or other printed material and more particularly to a stacking apparatus in which a succeeding booklet is piled on top of a preceding booklet.

As used herein, the term "booklet" includes generally flat articles which may have a thickness of several sheets or folds as well as a generally flat article comprising only a single fold or sheet in thickness. In its broader sense, as used herein, the term booklet may also include material which is at least initially devoid of printing or other graphics.

In present day printing plants, booklets are typically delivered from a printing press or a folding machine as a continuous stream of booklets arranged in a shingled fashion, i.e., with the front of a succeeding booklet overlapping the tail of a preceding booklet.

Conventional apparatuses for stacking booklets utilize bottom stacking, i.e., an arrangement in which a succeeding booklet in a stream of shingled booklets is introduced beneath the preceding booklet in the stream, with the first booklet introduced into the stack remaining at the top of the stack as the stack grows. In order to bottom stack shingled booklets, the stream of shingled booklets leaving the printing press or folding machine must first be inverted. This is usually accomplished by moving the stream of shingled booklets along a conveyor belt around a drum in a reverse loop. At the conclusion of the reverse loop, the front of a succeeding booklet underlaps the tail of a preceding booklet.

Although reverse looping devices may be satisfactory for some sizes of booklets, they are not sufficiently versatile to handle all sizes of booklets, especially smaller ones, without mishaps during the inverting procedure and the steps leading up to and following the inverting procedure. For example, the stream of booklets is carried around the inverting drum on a plurality of relatively narrow belts spaced apart from each other in a lateral direction. When a small booklet is carried around the drum, the booklet is carried by a single narrow belt only, rather than by a plurality of laterally spaced belts; and there is a much greater chance that the small booklet will become misaligned than where the booklet is larger and is being carried by a plurality of laterally spaced belts.

SUMMARY OF THE INVENTION

The present invention avoids the drawbacks of the prior art bottom stackers. The present invention provides an apparatus which takes a stream of shingled booklets, just as the stream left the printing press or folding machine, and stacks the booklets in a pile without inverting the stream. No reverse looping is required.

The booklets are stacked in a pile with a succeeding booklet dropped atop the preceding booklet from the stream, and, when the vertical stack reaches a predetermined size or height, the entire stack is removed, as a stack, from the stacking apparatus without interrupting delivery to the stacking apparatus of the stream of booklets from the folding machine or printing press. The top stacking apparatus of the present invention is quite versatile and can accommodate virtually all sizes of booklets, large and small.

Other features and advantages are inherent in the structure claimed and disclosed or will become apparent to those skilled in the art from the following detailed description in conjunction with the accompanying diagrammatic drawing.

BRIEF DESCRIPTION OF THE DRAWING

FIG. 4 is an enlarged fragmentary sectional view of an intermediate portion of the apparatus, downstream from the portion illustrated in FIG. 3;

FIG. 6 is an enlarged fragmentary plan view of a linkage used in an embodiment of the apparatus;

DETAILED DESCRIPTION

Figure 1:
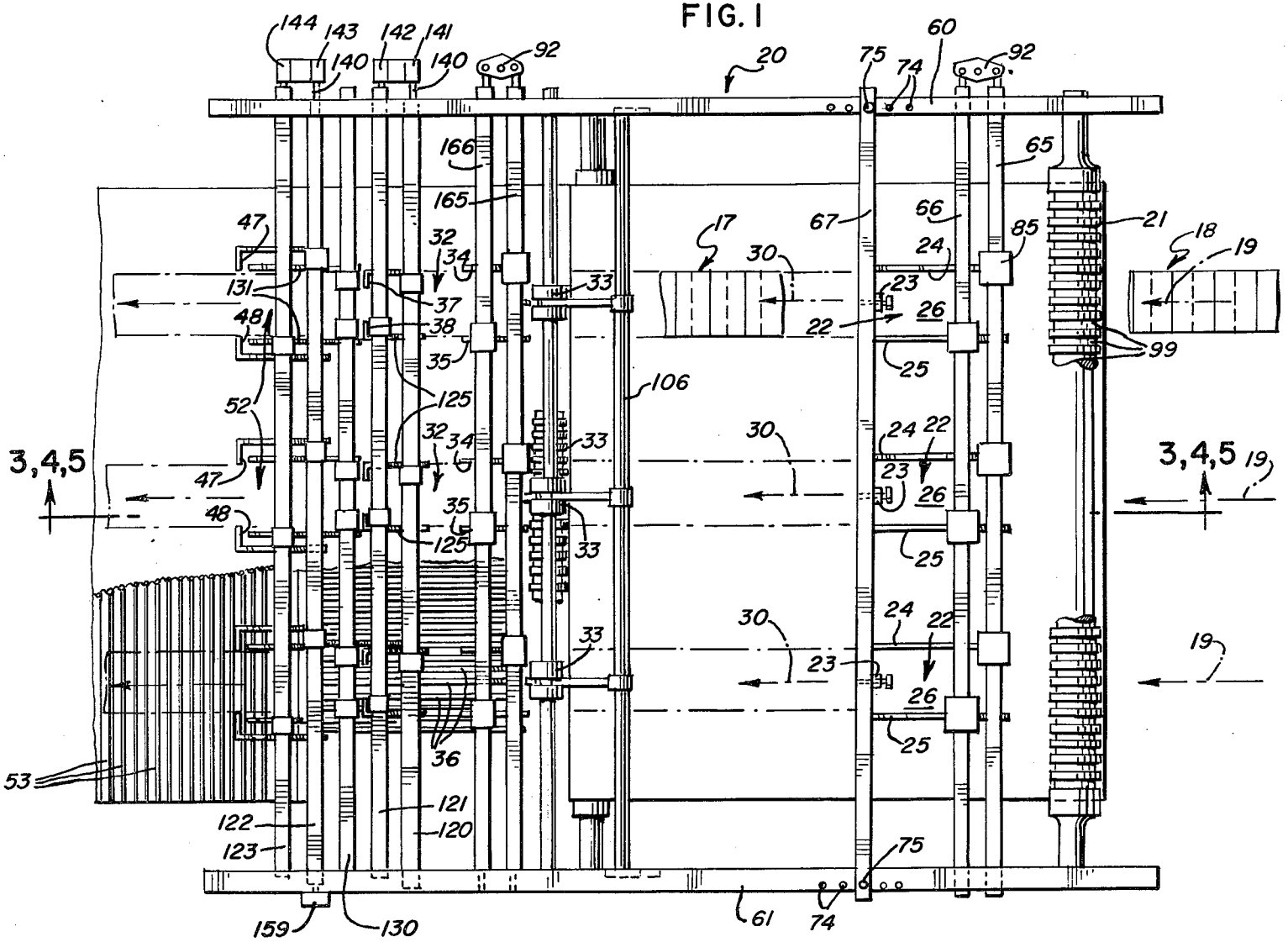
FIG. 1 is a plan view of an apparatus in accordance with an embodiment of the present invention.
Figure 2:
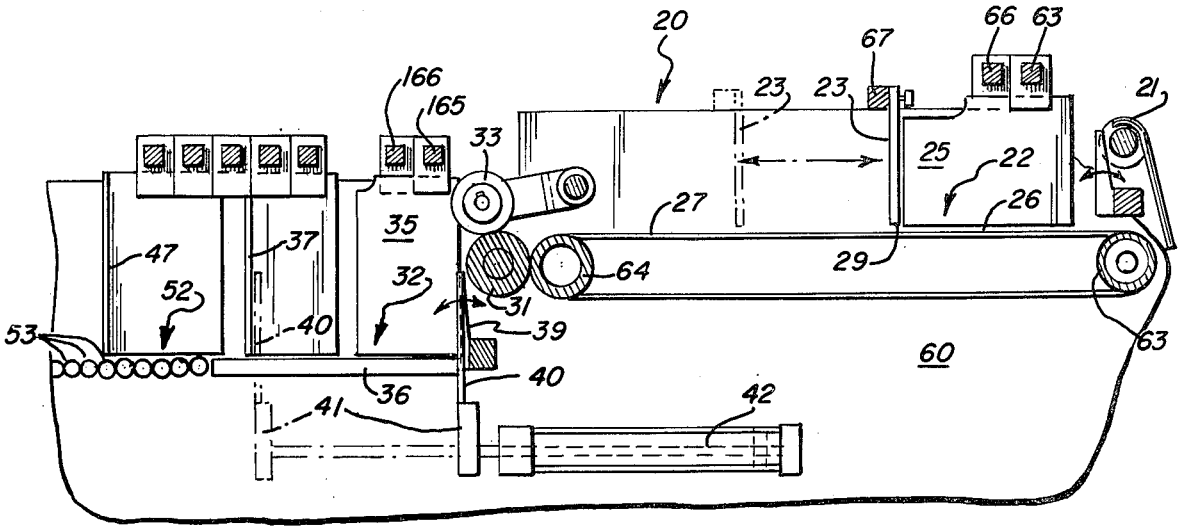
FIG. 2 is a side sectional view of the apparatus.

Referring initially to FIGS. 1 and 2, indicated generally at 20 is an apparatus for the top stacking of booklets, constructed in accordance with an embodiment of the present invention. In operation, a continuous stream 18 (or streams) of unstacked booklets approach apparatus 20 along paths indicated in dash-dot lines at 19 in FIG. 1. The booklets in each stream 18 are carried by conventional conveying means, such as a conveyor belt (not shown), and the booklets in stream 18 are in a shingled relation, with the front of a succeeding booklet overlapping the tail of a preceding booklet.

Figure 3:
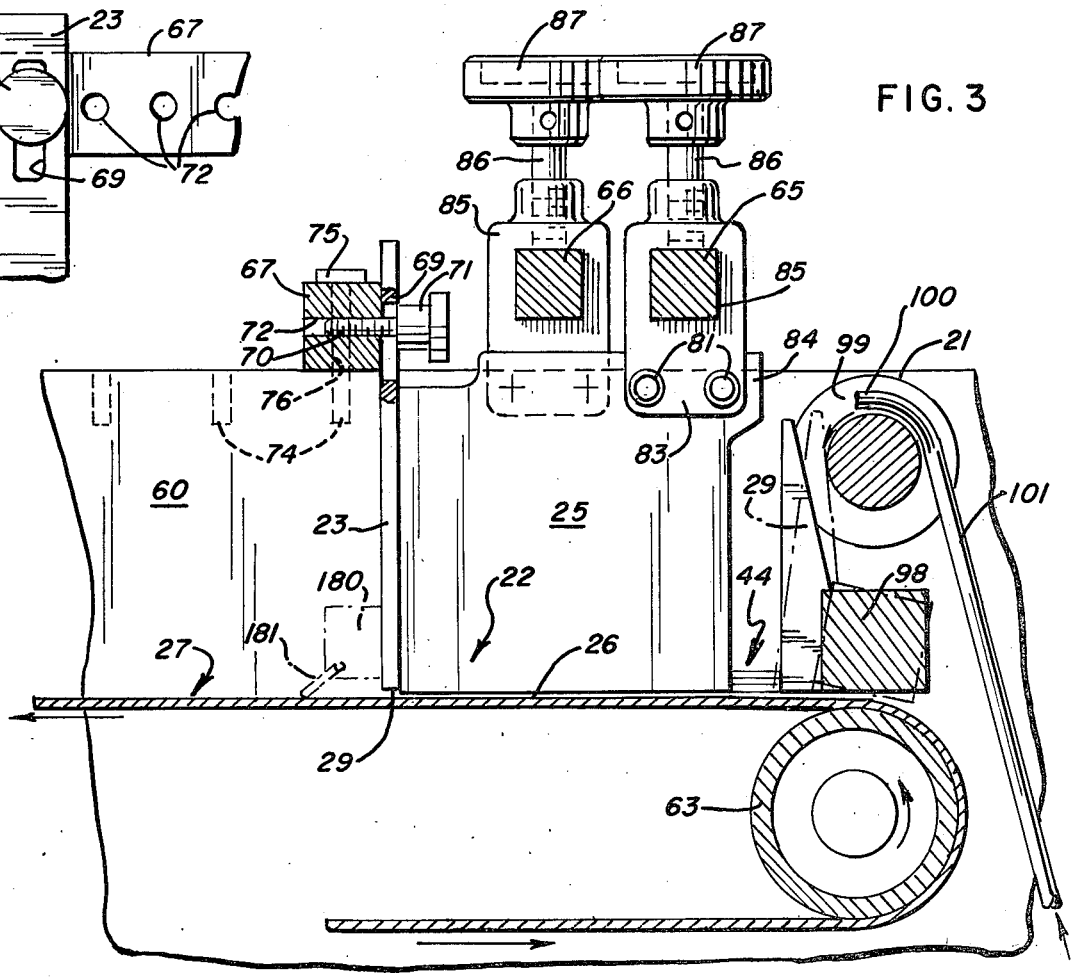
FIG. 3 is an enlarged fragmentary sectional view of an upstream end portion of the apparatus.

Each continuous stream of booklets is received on a circumferentially grooved driving wheel 21 which delivers the booklets to a first stacking location indicated generally at 22. Referring to FIGS. 2 and 3, first stacking location 22 has a downstream end defined by a metering gate 23, a pair of sides defined by side aligning plates 24, 25, an upstream end defined by a plurality of laterally spaced back aligning fingers 29 (FIG. 3) and a bottom defined by an upstream portion 26 of a conveyor belt 27.

While conveyor belt 27 is operating, a booklet dropping to the bottom of first stacking location 22, onto upstream portion 26 of the conveyor belt, is immediately conveyed by belt 27 below the bottom 29 of metering gate 23, in a downstream direction along belt 27. Gate bottom 29 is spaced above the top of conveyor belt 27 to allow a booklet to pass below the gate. Gate 23 may be vertically adjusted to increase or decrease the space between gate bottom 29 and the top of conveyor belt 27 to accommodate booklets of differing thicknesses.

Referring to FIGS. 1–4, conveyor belt 27 feeds a continuous stream 17 of shingled booklets in a downstream direction along a path 30 (dash-dot lines) towards a second stacking location indicated generally at 32. The booklets in the continuous stream approaching downstream stacking location 32 are in the same shingled relation as that in which they entered the apparatus, with the front of a succeeding booklet overlapping the tail of the preceding booklet.

Booklets leaving conveyor belt 27 for second stacking location 32 are fed into the nip between a second circumferentially grooved driving wheel 31 and an undriven, weighted wheel 33 located above driving wheel 31. Wheels 31, 33 deliver the booklets to an unsupported position above the second stacking location, and the booklets drop down atop a stack 43.

Second stacking location 32 has a downstream end defined by a first set of gate members 37, 38, a pair of sides defined by side aligning plates 34, 35, an upstream end defined by a plurality of laterally spaced back aligning fingers 39, and a bottom defined by a plurality of laterally spaced finger ramps 36.

As the vertical stack of booklets 43 accumulates at second stacking location 32, the vertical sides of the stack are aligned by side aligning plates 34, 35 which oscillate back and forth toward and away from each other, and the back of the vertical stack is aligned by back aligning fingers 39 which oscillate back and forth toward and away from the stack.

When a stack of booklets 43 attains a predetermined height or contains a predetermined number of booklets, this is sensed and conveyor belt 27 is stopped. Then, after a short delay, the first set of gate members 37, 38 are drawn apat from a closed position in which they obstruct further downstream movement of the stack of booklets (FIG. 1) to an open position which does not obstruct such movement. When the first set of gate members 37, 38 opens, a second set of gate members 47, 48 simultaneously move together to a closed position which will prevent further downstream movement of a stack of booklets beyond gate members 47, 48.

Located directly behind the stack of booklets 43 at second stacking location 32 is an ejector finger 40 extending upwardly from a laterally disposed cross member 41 connected to the piston of a pneumatic cylinder 42 (FIG. 2) located below conveyor belt 27. When the first set of gate members 37, 38 open and the second set of gate members 47, 48 close, cross member 41 is moved outwardly in a downstream direction, causing ejector finger 40 to engage the back of a stack of booklets 43 and displace the booklets, as a stack, in a downstream direction along finger ramps 36 from second stacking location 32 to a third location, indicated generally at 52, atop a plurality of laterally extending, driven rollers 53. The downstream end of location 52 is defined by the second set of gate members 47, 48 which prevent further downstream movement of the stack atop driven rollers 53.

After the vertical stack of booklets is displaced to third location 52, cross member 41, with ejector finger 40, is retracted to its initial upstream position by pneumatic cylinder 42. At the same time the first set of gate members 37, 38 is closed and the second set of gate members 47, 48 is opened allowing the stack to be conveyed, as a stack, downstream from location 52 by rollers 53. When the gate members return to their original positions, conveyor belt 27 is turned on.

While conveyor belt 27 was turned off, a temporary holding stack of booklets 44 was accumulating at first stacking location 22, supported by upstream conveyor portion 26 (FIG. 3). The vertical sides of the temporary holding stack are aligned by side aligning plates 24, 25 which oscillate back and forth toward and away from each other, and the back of the stack is aligned by back aligning fingers 29 which oscillate back and forth toward and away from the stack.

The temporary holding stack is depleted once conveyor belt 27 resumes operation, with the depletion occurring at a rate faster than the temporary holding stack accumulated. This is accomplished by operating conveyor belt 27 at a speed faster than the speed at which the booklets are fed to first stacking location 22. This causes booklets to be removed from the bottom of the stack at a rate faster than the rate at which booklets are being piled atop the stack, thereby causing the temporary holding stack to shrink.

When conveyor belt 27 is restarted, booklets are once again removed from the bottom of the temporary holding stack as a continuous stream of booklets in shingled relation, with the front of a succeeding booklet overlapping the tail of a preceding booklet.

Describing the apparatus now in greater detail, and referring initially to FIGS. 1–3, apparatus 20 comprises a pair of side members 60, 61 between which are mounted grooved drive wheel 21 and conveyor rollers 63, 64 for conveyor belt 27.

Also extending between side members 60, 61 are a pair of cross bars 65, 66 each mounting a respective side aligning plate 24, 25. Cross bars 65, 66 are mounted for sliding movement, in an axial direction, on members 60, 61.

Figure 8:
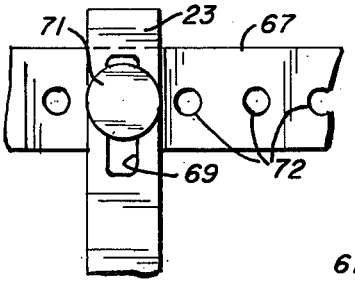
FIG. 8 is an enlarged fragmentary front view of a part of the apparatus.

Rigidly mounted between side members 60, 61 is a cross bar 67 from which metering gate 23 depends. As previously indicated, gate 23 is vertically adjustable relative to cross bar 67. This is accomplished by providing gate 23 with a vertically disposed slot 69 near the top of gate 23 (FIGS. 3 and 8). The shank portion 70 of a threaded member 68 extends through slot 69 and engages within one of several threaded openings 72 in cross bar 67. The head portion 71 of threaded member 68 engages gate 23, on the outer surface thereof, around slot 69. When threaded member 68 is tightened, by screwing it into cross bar 67, gate 23 is held in a vertically fixed position, sandwiched between cross bar 67 and threaded member 68. When threaded member 68 is loosened, gate 23 may be raised or lowered, with the upper and lower ends of slot 69 defining the limits of vertical adjustment.

The lateral position of gate 23 along cross bar 67 may be adjusted by removing threaded member 68, changing the threaded opening 72 with which slot 69 on the gate 23 is aligned, and re-inserting threaded member 68 in the newly selected opening 72.

Gate 23 is also adjustable in upstream and downstream directions. This may be accomplished by structure comprising a plurality of holes 74 in the top of side members 60, 61 and a pair of openings 76 extending vertically through cross bar 67 at opposite ends thereof (FIG. 3). Openings 76 in cross bar 67 are aligned with openings 74 in members 60, 61, and cross bar 67 is secured in place with a pin 75 extending through openings 76, 74, for example.

An alternative arrangement for adjusting the location of gate 23 in upstream and downstream directions comprises mounting cross bar 67 for sliding movement in upstream and downstream directions on side members 60, 61. At each end of the cross bar is a clamp which can be tightened to hold the cross bar in a desired position and loosened to permit sliding movement of the cross bar to a new position.

Referring to FIG. 3, each side aligning plate 24, 25 depends from a respective cross bar 65, 66 each mounted for reciprocating movement, along the axis of the bar, between side members 60, 61. The attachment of each end plate 24, 25 to its respective cross bar 66, 65 is essentially identical, and the attaching structure will be described here in connection with side aligning plate 25 which has an upper portion 84 connected by fasteners 81 to a depending portion 83 on a block 85 slidably mounted on cross bar 65.

Block 85 is held against sliding movement on cross bar 65 by a clamping screw 86 having a handle 87 which may be turned to loosen the clamping screw to adjust the location of block 85 and its side aligning plate 25 in relation to first stacking location 22. Such an adjustment may occur to accommodate a change in the width of a booklet received a first stacking location 22.

Side aligning plates 24, 25 are continuously oscillated back and forth toward and away from each other by structure illustrated in detail in FIG. 6. Cross bars 66, 65 have respective terminal portions 88, 89 connected by pivotal connections 90, 91 to opposite ends of a first link member 92 having its mid-portion fixed on a shaft 93 in turn fixed to one end of a second link member 84 having an opposite end pivotally connected at 95 to a terminal portion 96 of a shaft 97 oscillated back and forth along its axis by conventional oscillating means not shown.

As shaft 97 oscillates back and forth along its axis, the structure connecting it to cross bars 66, 65 causes the latter to oscillate back and forth, along their respective axes, to move side plates 24, 25 back and forth toward and away from each other. Cross bars 66, 65, extend slidably through respective openings 98, 99 in side member 60, and the opposite ends of these cross bars extend through similar slide-accommodating openings in opposite side member 61.

Referring again to FIG. 3, back aligning fingers 29, which function to line up the back of a temporary holding stack 44, are mounted on a cross arm 98 extending between side members 60, 61. Cross arm 98 is mounted for oscillating movement about its axis, thereby to cause finger 29 to oscillate back and forth between the full line and phantom line positions illustrated in FIG. 3. Arm 98 may be oscillated using structure similar to that shown in FIG. 6 for oscillating shaft 93.

Located in a groove 99 of grooved driving wheel 21, adjacent first stacking location 22, is the tip or nozzle 100 of an air line 101 for directing a stream of air against the bottom surface of a booklet delivered by grooved driving wheel 21 to an unsupported position above the bottom of first stacking location 22. The air stream directed against the bottom of the booklet causes the booklet to flutter as it drops downwardly. This assists in the proper piling and alignment of the booklet on temporary holding stack 44 and in the proper positioning of the booklet at stacking location 22 atop upstream conveyor portion 26.

Referring to FIG. 2, cross member 41, operated by pneumatic cylinder 42, has opposite ends mounted for slidable movement on apparatus side members 60, 61.

Referring now to FIG. 4, grooved driving wheel 31 is driven about a horizontal axis extending transverse to the downstream movement of a booklet engaged between lower driven wheel 31 and upper, undriven, weighted wheel 33. Undriven wheel 33 is mounted for rotation about a second horizontal axis extending substantially parallel to the axis of driven wheel 31. Undriven wheel 33 is connected to the downstream end of an arm 105 having an upstream end mounted for pivotal movement about the axis of a horizontal shaft 106 located upstream of the axis of undriven wheel 33. Arm 105 may be held against pivotal movement about the axis of shaft 106 by tightening a thumb screw 107 located near the upstream end of arm 105 and engageable with the outer surface of shaft 106.

Undriven wheel 33 cooperates with driven wheel 31 to deliver a booklet, in a substantially horizontal disposition, to an unsupported position directly above stack-supporting finger ramps 36. In addition, when stack 43 at second stacking location 32 has reached a predetermined height, and conveyor belt 27 is stopped, it is possible that a booklet may be only partially delivered onto the stack. In such a situation, upper wheel 33 cooperates with lower driven wheel 31 to complete the delivery of the imcompletely delivered booklet before displacement of the stack from location 32 by ejector finger 40.

It is desirable that a booklet be delivered from wheels 31, 33 in a substantially horizontal disposition. To correct for deviations from this disposition, when delivered, structure is provided for adjusting the axis of shaft 106 in upstream and downstream directions relative to the axis of wheel 31, as shown in FIG. 9.

Figure 9:
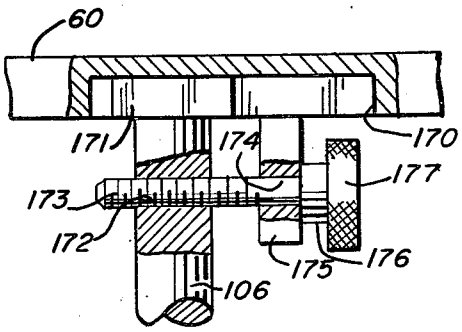
FIG. 9 is an enlarged fragmentary plan view, partially in section, of another part of the apparatus.

Each end of shaft 106 is adjustably slidably mounted on respective side members 60, 61 by similar structure illustrated, for side member 60, in FIG. 9. Side member 60 has a recessed groove 170 slidably receiving a block 171 carrying an end of shaft 106 through which extends a threaded opening 172 receiving the shank 173 of a threaded member also extending through an unthreaded opening 174 in a bracket 175 fixed to side member 60. A shoulder 176 on the threaded member abuts bracket 175. A handle 177 on the threaded member may be turned to rotate threaded shank 173 in threaded shaft opening 172 thereby causing shaft 106 to move downstream or upstream, depending upon the direction in which handle 177 is turned, with block 171 sliding in recessed groove 170.

Upper wheel 33 is relatively massive to provide the wheel with a relatively heavy weight to urge the wheel downwardly against a booklet located between upper wheel 33 and lower wheel 31.

Although not shown in FIG. 4, in a groove 99 of groove wheel 31 is located the tip of an air line, similar to nozzle 100 used in connection with grooved driving wheel 21 in FIG. 3 and serving the same function.

At second stacking location 32, side aligning plates 34 and 35 are mounted on cross bars 165, 166 respectively, using the same type of mounting arrangement as was used at first stacking location 22 to mount side aligning plates 24, 25 on cross bars 65, 66, respectively (see FIG. 3); and side aligning plates 34, 35 are oscillated back and forth utilizing the same type of arrangement as was utilized to oscillate side plates 24, 25 (see FIG. 6).

Back aligning fingers 39, at second stacking location 32, are mounted on a cross arm 198 operated identically to the cross arm 98 mounting back aligning fingers 29 at first stacking location 22 (FIG. 3)

Figure 5:
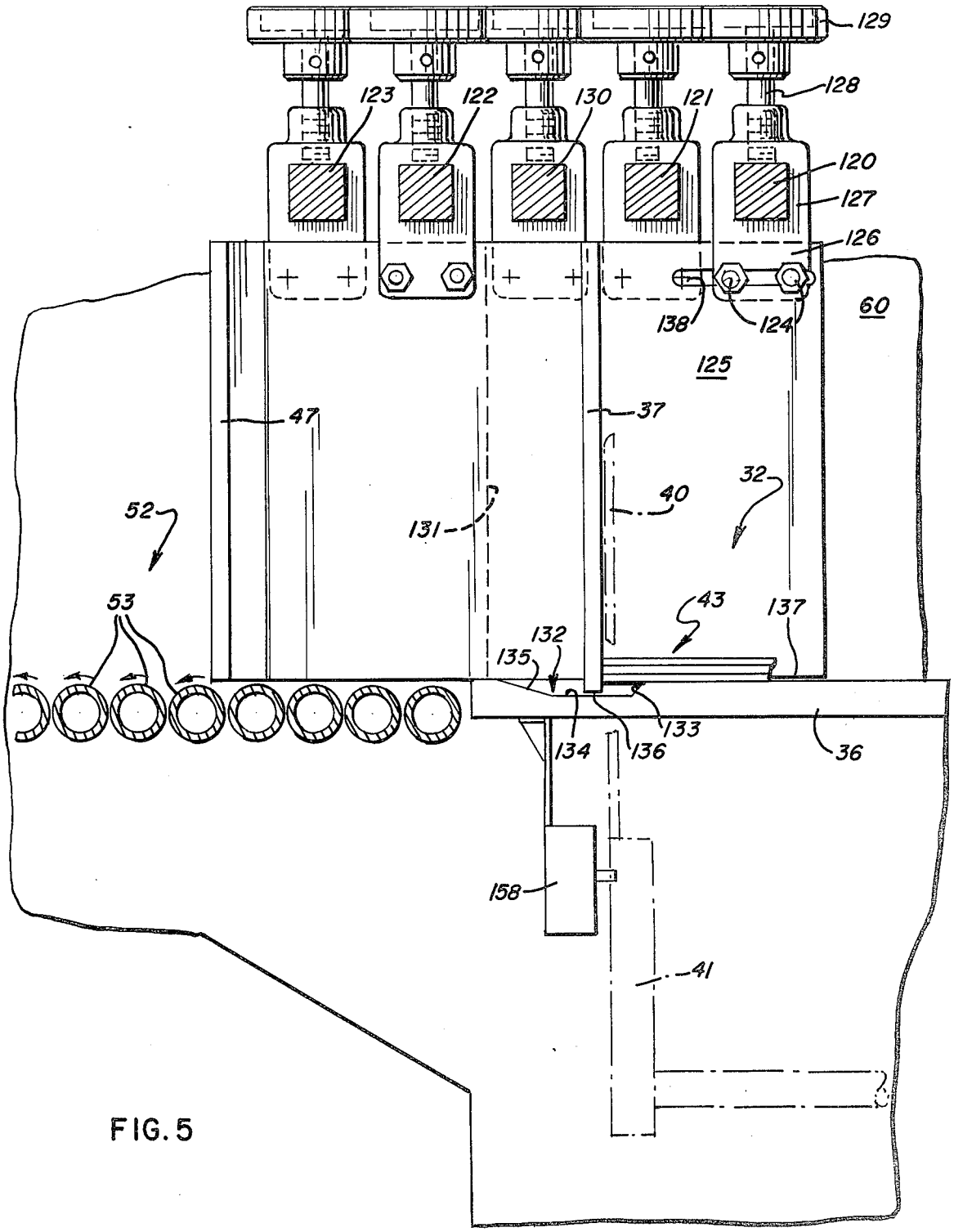
FIG. 5 is an enlarged fragmentary sectional view of a downstream end portion of the apparatus.

Referring now to FIG. 5, end gate members 37, 38 and 47, 48 are mounted on cross arms 120, 121, 122 and 123, respectively. The mounting of each gate member on its respective cross arm is essentially identical. Accordingly, only the mounting for gate member 37 will now be described, the other mountings for the other gate members being essentially the same, unless otherwise indicated.

Gate member 37 is at the downstream end of a vertical guide plate 125 defining at least part of a side of second stacking location 32. Guide plate 125 is connected by fasteners 124 to a depending portion 126 of a block 127 slidably mounted on cross arm 120. A threaded member 128 may be tightened by a handle 129 to hold block 127, guide plate 125 and gate member 37 in a fixed position on cross arm 120. Similarly, threaded member 128 may be loosened, and block 127, with the attached guide plate 125 and gate member 127, moved slidably along arm 120 to widen or narrow the space between adjoining gate members 37, 38.

Located between cross arms 121 and 122 is a further cross arm 130 on which are mounted vertically disposed guide rails 131, extending downstream between the first set of gate members 37, 38 and the second set of gate members 47, 48 to guide the stack when it is displaced from second stacking location 32 to third location 52. Each of the guide rails 131 is mounted on its respective cross arm 130 in a manner similar to the mounting of guide plate 125 on cross arm 120.

Each finger ramp 36 includes a plurality of longitudinally extending notches 132 each comprising a sharply descending upstream edge 133, a gradually ascending downstream edge 135 and a substantially flat intermediate edge 134 between the upstream and downstream edges.

The bottom 136 of gate member 37 is located within notch 132 so as to be disposed below the bottom surface of the bottom booklet in the vertical stack of booklets 43 resting on top surface 137 of finger ramp 36. This prevents the bottom booklet in stack 43 from working its way under gate member 37 before the stack is displaced, as a stack, from second stacking location 32. When gates 37, 38 are opened and the stack of booklets is displaced from location 32 downstream to location 52, the downstream or front portion of the bottom booklets may dip into notch 132, but the gradually ascending downstream notch edge 135 smoothly guides the front portion of the moving booklets up out of the notch.

Notches 132 in adjoining finger ramps 36 are aligned laterally to maintain gate member 37 in the above described desired disposition in notch 132 when the gate member is being laterally adjusted along its cross arm 120.

A slot 138 at the top of guide plate 125 permits adjustment of the location of gate bottom 136 along the length of notch 132. This is accomplished by loosening fasteners 124, which extend through slot 138, and sliding guide plate 125, with gate member 37, to a position in which the gate member abuts the downstream end of the stack, and then retightening fasteners 124.

Referring to FIG. 1, each cross arm 120–123 is slidable axially on side members 60, 61. One end of each cross arm 120–123 terminates at a rod 140 connected to the piston of a pneumatic cylinder 141–144, respectively. Pneumatic cylinders 141, 142 operate cross arms 120, 121 respectively, and the cylinders are synchronized so that cross arms 120 and 121 are urged in respective opposite directions at the same time. Accordingly, when pneumatic cylinders 141, 142 are operated, arms 120, 121 are simultaneously urged in respective opposite directions thereby moving gate members 37, 38 either away from each other or toward each other depending upon which direction the arms are urged. The same type of operation occurs for arms 122, 123 operated by pneumatic cylinders 143, 144.

The first set of gate members 37, 38 are normally in a closed position, and the second set of gate members 47, 48 are normally in an open position. These are the positions illustrated in FIG. 1. When the gates and their respective arms are in the positions illustrated in FIG. 1, the pistons in pneumatic cylinders 141 and 143 are in their extended position while the pistons in pneumatic cylinders 142, 144 are in their retracted position.

When gate members 37, 38 are moved from the closed positions of FIG. 1 to their open positions, the piston in cylinder 141 is moved to its retracted position and the piston in cylinder 142 is moved to its extended position. Similarly, when gate members 47, 48 are moved from the closed positions illustrated in FIG. 1 to their open positions, the piston in cylinder 143 is moved to its retracted position and the piston in cylinder 144 is moved to its extended position.

Each of gate members 37, 38 has an L-shaped horizontal cross-section for engaging vertical stack 43 adjacent a respective front corner portion of the stack when the gate member is in its closed position. When gate members 37, 38 are moved laterally apart to their open positions, they need be moved only a very short distance (e.g., ½ inch or so), a distance substantially less than the lateral spacing between gate members 37, 38 when they are in their closed positions. Because gate members 37, 38 need only be moved a very short distance to remove any obstruction to downstream movement of vertical stack 43, the time required to open this set of gate members is relatively short compared to the time required if the gate was defined by a plate which had to be raised or pivoted from a closed to an open position, for example.

Figure 7:
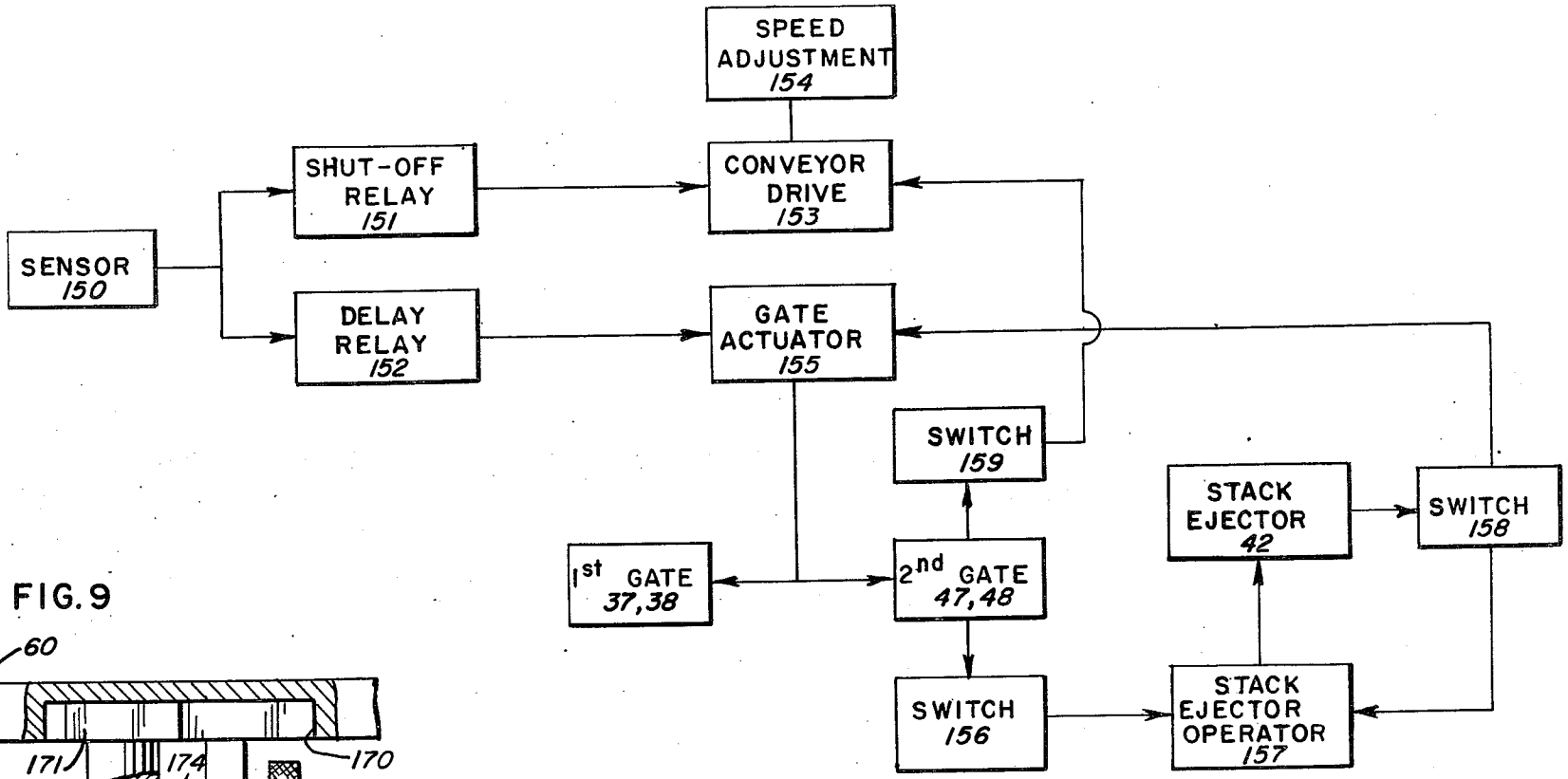
FIG. 7 is a schematic illustrating a sequence of operations of the apparatus.

FIG. 7 illustrates the sequence of operations which occurs when a stack at the second stacking location attains a predetermined size or height or contains a predetermined number of booklets.

Typically, a sensor determines when a predetermined number of booklets have accumulated in stack 43 at second stacking location 32, and the sensor then actuates the rest of the mechanism. This sensor may be located at any appropriate location along apparatus 20. In one embodiment, it may be located upstream of apparatus 20 at the folding machine or printing press which feeds the continuous stream of booklets to apparatus 20, when the printing press, folding machine and stacking apparatus are all part of a continuous, uninterrupted operation.

For example, a counter which counts the number of revolutions of the printing cylinder on a printing press can be utilized as the sensor. This is because the number of booklets entering apparatus 20 in a given time period is directly proportional to the number of revolutions of the printing press cylinder in that time period; and the number of booklets accumulating in a stack at second stacking location 32 is, in the given time period, the same as the number of booklets entering apparatus 20. This is so even though conveyor belt 27 is shut down during the time a stack is ejected from second stacking location 32, causing a temporary holding stack to build up at first stacking location 22. However, the time period during which conveyor belt 27 is shut down is relatively short, and the speed with which conveyor belt 27 operates is relatively fast, compared to the speed with which the booklets are fed into first stacking location 22. As a result, during a given cycle of operation, between successive ejections of booklet stacks from second stacking location 32, the number of booklets fed to second stacking location 32 is the same as the number of booklets delivered to first stacking location 22.

More specifically, assume that the printing press cylinder turns out four booklets in a stream per cylinder revolution and operates at a speed of two revolutions per second, thereby forming a stream to which are added eight booklets per second. This stream moves through a folding machine and enters stacking apparatus 20 at the same rate, viz., eight booklets per second. Assume that it takes two seconds to displace a stack from second stacking location 32 and that a stack is complete when it contains 80 booklets. Accordingly, it would take ten seconds for 80 booklets to be delivered to apparatus 20 (with a delivery rate of eight booklets per second). Conveyor belt 27 would then be operated at a speed to deliver 10 booklets per second to second stacking location 32 during each of the eight seconds the conveyor belt runs. Such a speed depletes the temporary holding stack of 16 booklets which accumulated at location 22 during the two second shutdown of conveyor belt 27 and also carries away from location 22 the additional 64 booklets delivered there during the eight second running time of belt 27. In normal operation, there would be a continuous stream of booklets extending all the way from a location just upstream of second stacking location 32 back to the printing press cylinder.

In the above described example, each complete operating cycle takes 10 seconds, and begins when the conveyor belt shuts down. Accordingly, the counter at the printing press cylinder would begin counting at the same time. When the counter has counted 20 revolutions of the printing press cylinder, 10 seconds have elapsed and 80 booklets have accumulated at second stacking location 32 (no booklets during the first two seconds, when belt 27 was stopped, and 10 booklets per second during each of the last eight seconds). The counter would then actuate the mechanism to eject the stack from location 32 and start counting again.

In an alternative embodiment, indicated by phantom lines in FIG. 3, a conventional counter 180, employing a feeler member 181, may be employed to count, by feel, the number of booklets passing under metering gate 23.

Assuming, then, that a predetermined number of booklets have accumulated at second stacking location 32, sensor 150 actuates a shutoff relay 151 which stops the conveyor drive 153 for conveyor belt 27. The conveyor drive may comprise a magnetic clutch (not shown), of conventional construction, which transmits driving power from a motor (not shown) to one or both of wheels 63, 64 for conveyor belt 27. In such an embodiment, actuation of shut off relay 151 would disengage the magnetic clutch. The speed of conveyor belt 27 may be adjusted utilizing a conventional speed adjustment device 154 connected to conveyor drive 153.

Sensor 150 also actuates a delay relay 152 which, after a predetermined delay, operates a gate actuator 155 which may comprise valve means, of conventional construction, for selectively channeling compressed air to one end or the other of pneumatic cylinders 140–143. Operation of gate actuator 155 is delayed, until a time after conveyor belt 27 has been stopped, to permit completion of delivery to stack 43 of a booklet which was only partially delivered at the time conveyor belt 27 was stopped.

Operation of gate actuator 155 by delay relay 152 opens the first set of gates 37, 38 and closes the second set of gates 47, 48. More specifically, relay 152 causes the valve means of gate actuator 155 to channel compressed air to pneumatic cylinders 140–143 in such a manner as to move the pistons in cylinders 141 and 143 from retracted to extended positions and the pistons in cylinders 142 and 144 from extended to retracted positions, thus causing corresponding movement of cross arms 120–123 and their respective gate members 37, 38 and 47, 48.

When the second set of gate members 47, 48 move to their closed positions, one of the cross arms 122, 123 engages a switch 156 (not shown other than schematically in FIG. 7) and switch 156 activates a stack ejector operator which may comprise valve means, of conventional construction, for selectively channeling compressed air to one end or the other of stack ejector cylinder 42. Activation by switch 156 causes the valve means to channel compressed air to cylinder 42 in such a manner as to move the piston in cylinder 42 from a retracted position to an extended position, in turn causing cross member 41 with ejector finger 40 to move from the retracted positions shown in full lines in FIG. 2 to the extended positions shown in phantom lines in FIG. 2.

Referring to FIG. 5, when cross member 41 reaches its extended position it engages a switch 158 which in turn causes the stack ejector operator 157 to channel compressed air to cylinder 42 in such a manner as to retract the piston therein. This, in turn, retracts cross member 41 and ejector finger 40 from their extended positions to their retracted positions shown in FIG. 2 in solid lines. Switch 158 also operates gate actuator 155 which channels compressed air to cylinders 140–143 in such a manner as to return the pistons in cylinders 142 and 144 to retracted positions and return the pistons in cylinders 141 and 143 to extended positions. This, in turn, causes the first and second sets of gate members to return to their original positions. When gate members 47, 48 return to their original positions, shown in FIG. 1, arm 122 mounting gate member 47, engages a switch 159 (FIGS. 1 and 7) which operates conveyor drive 153 to again drive conveyor belt 27, e.g., by reengaging the magnetic clutch in the conveyor drive.

All side aligning plates 24, 25 and 34, 35 and all back aligning fingers 29, 39 operate continuously without stoppage during both accumulation and ejection of stack 43 and accumulation and depletion of temporary holding stack 44.

The foregoing detailed description has been given for clearness of understanding only, and no unnecessary limitations should be understood therefrom, as modifications will be obvious to those skilled in the art.

What is claimed is:

1. An apparatus for the top stacking of booklets, said apparatus comprising:

means for supporting a stack of booklets;

first conveying means for conveying a stream of unstacked booklets in a downstream direction toward said stack-supporting means;

means for piling booklets from said stream to form a vertical stack atop said stack-supporting means;

means normally actuated to restrain movement of said stack in a downstream direction from said stack-supporting means;

means, responsive to said stack attaining a predetermined size, for deactuating said restraining means, to permit movement of said stack in a downstream direction;

second conveying means downstream of said stack-supporting means;

means for displacing the entirety of said stack as a whole from said supporting means, in a downstream direction, to said second conveying means when said restraining means is deactuated;

second restraining means actuable to restrain movement of the stack in a downstream direction on said second conveying means;

and means for actuating said second restraining means when said first-recited restraining means is deactuated.

2. An apparatus for the top stacking of booklets, said apparatus comprising;

means for supporting a stack of booklets;

first conveying means for conveying a stream of unstacked booklets in a downstream direction toward said stack-supporting means;

means for piling booklets from said stream to form a vertical stack atop said stack-supporting means;

means normally actuated to restrain movement of said stack in a downstream direction from said stack-supporting means;

means, responsive to said stack attaining a predetermined size, for deactuating said restraining means, to permit movement of said stack in a downstream direction;

means for displacing the entirety of said stack as a whole from said supporting means, in a downstream direction, when said restraining means is deactuated;

said restraining means comprising gate means depending downwardly from a support located above said stack-supporting means and actuable between a closed, restraining position and an open, movement-permitting position;

a gate bottom on said gate means;

and gate bottom-accommodating means on said stack-supporting means for permitting said gate bottom to extend below the bottom of said stack when the gate means is in its closed position, to prevent a bottom booklet in said stack from moving under said gate means.

3. An apparatus as recited in claim 2 wherein:

said stack supporting means comprises a plurality of laterally spaced, elongated finger means extending in a downstream direction;

and said gate bottom-accommodating means comprises notch means in said finger means for receiving said gate bottom.

4. An apparatus as recited in claim 3 wherein:

said notch means extends longitudinally in a downstream direction and comprises a sharply descending upstream edge, a gradually ascending downstream edge, and a substantially flat intermediate edge between said upstream and downstream edges;

said apparatus comprising means for adjusting the location of said gate bottom along the length of said notch.

5. An apparatus for the top stacking of booklets, said apparatus comprising:

means for supporting a stack of booklets;

first conveying means for conveying a stream of unstacked booklets in a downstream direction toward said stack-supporting means;

means for piling booklets from said stream to form a vertical stack atop said stack-supporting means;

means normally actuated to restrain movement of said stack in a downstream direction from said stack-supporting means;

means, responsive to said stack attaining a predetermined size, for deactuating said restraining means, to permit movement of said stack in a downstream direction;

means for displacing the entirety of said stack as a whole from said supporting means, in a downstream direction, when said restraining means is deactuated;

said restraining means comprising a pair of vertically disposed members spaced laterally from each other;

and means mounting said members for lateral movement in respective opposite directions, between a first position in which said members obstruct downstream movement of said stack and a second non-obstructing position, and for a distance less than the lateral spacing between said members when they are in their first position.

6. An apparatus as recited in claim 5 wherein:

each of said vertically disposed members has an L-shaped horizontal cross-section for engaging a respective front corner portion of said stack when the member is in its first position.

* * * * *